US011109672B2

(12) United States Patent
Anderson et al.

(10) Patent No.: US 11,109,672 B2
(45) Date of Patent: Sep. 7, 2021

(54) VERTICALLY ADJUSTABLE DESK WITH UNDER-CARRIAGE MOUNTING SYSTEM

(71) Applicant: Squaregrove, LLC, Austin, TX (US)

(72) Inventors: Eric W. Anderson, Austin, TX (US); Jon Daniel Paulsen, Austin, TX (US); Bryce Robert Bowerman, Hutto, TX (US)

(73) Assignee: SQUAREGROVE, LLC, Austin, TX (US)

( * ) Notice: Subject to any disclaimer, the term of this patent is extended or adjusted under 35 U.S.C. 154(b) by 0 days.

(21) Appl. No.: 16/686,747

(22) Filed: Nov. 18, 2019

(65) Prior Publication Data

US 2020/0154880 A1 May 21, 2020

Related U.S. Application Data

(60) Provisional application No. 62/770,030, filed on Nov. 20, 2018.

(51) Int. Cl.

| | |
|---|---|
| ***A47B 9/20*** | (2006.01) |
| ***A47B 21/02*** | (2006.01) |
| ***A47B 13/00*** | (2006.01) |
| *A47C 19/22* | (2006.01) |
| *A45F 3/24* | (2006.01) |

(52) U.S. Cl.

CPC ..... *A47B 9/20* (2013.01); *A47B 13/003* (2013.01); *A47B 21/02* (2013.01); *A45F 3/24* (2013.01); *A47B 2200/0051* (2013.01); *A47B 2200/0056* (2013.01); *A47C 19/22* (2013.01)

(58) Field of Classification Search

CPC ..... A47B 9/00; A47B 9/20; A47B 2200/0051; A47B 13/003; A47B 21/02; A47C 19/22

USPC ..... 108/20, 50.01, 50.02, 147

See application file for complete search history.

(56) References Cited

U.S. PATENT DOCUMENTS

| | | | | |
|---|---|---|---|---|
| 3,080,835 A * | 3/1963 | Guglielmi | A47B 9/10 108/116 |
| 4,586,759 A | 5/1986 | Wrobel | |
| 4,852,500 A * | 8/1989 | Ryburg | A47B 21/03 108/105 |
| 5,048,698 A | 9/1991 | Konrad | |
| 5,259,326 A * | 11/1993 | Borgman | A47B 9/00 108/147 |

(Continued)

FOREIGN PATENT DOCUMENTS

| | | | |
|---|---|---|---|
| CA | 3012778 A1 * | 1/2019 | A47B 9/20 |
| CN | 203647012 U | 6/2014 | |

(Continued)

*Primary Examiner* — Jose V Chen

(74) *Attorney, Agent, or Firm* — Middleton Reutlinger

(57) ABSTRACT

A vertically adjustable desk with an under carriage mounting system is described. The vertically adjustable desk may have a planar work surface and telescoping support legs which are operable to raise and lower the work surface. The vertically adjustable telescoping support legs may be height adjustable by at least one electronic motor. The under-carriage mounting system may include a first and a second U-shaped support bracket that each receives a first and second runner support, the U-shaped brackets affixed to respective first and second vertically adjustable telescoping support legs. The U-shaped support brackets may be used to mount accessories underneath the work surface.

10 Claims, 8 Drawing Sheets

(56) References Cited

U.S. PATENT DOCUMENTS 5,313,892 A * 5/1994 Tice ..... D05B 75/00 108/147
5,544,593 A 8/1996 Canfield et al.
5,692,712 A 12/1997 Weinschenck, Jr. et al.
5,704,299 A * 1/1998 Corpuz, Jr. ..... A47B 21/0314 108/147
5,911,178 A * 6/1999 Alexander ..... A47B 17/033 108/50.01
5,975,657 A 11/1999 LaCour
6,189,268 B1 2/2001 Carr et al.
6,340,910 B1 1/2002 Saeki
6,378,255 B1 4/2002 Eich et al.
6,402,111 B1 6/2002 Stewart et al.
6,712,433 B2 3/2004 Hellwig et al.
6,807,776 B2 10/2004 Girdwood et al.
6,935,247 B2 8/2005 Schaefers et al.
8,061,278 B2 11/2011 Skiba
8,196,525 B2 6/2012 Flanet
8,312,820 B2 * 11/2012 Rotlevi ..... A47B 21/00 108/50.01
8,967,054 B2 3/2015 Henriott et al.
9,102,017 B2 * 8/2015 Bentschneider ..... B23P 19/04
2004/0173125 A1 * 9/2004 Chang ..... A47B 21/03 108/50.01
2004/0237852 A1 * 12/2004 Tsai ..... A47B 21/03 108/92
2006/0065163 A1 * 3/2006 Chi ..... A47B 41/02 108/7
2009/0078167 A1 * 3/2009 Ellegaard ..... A47B 9/00 108/21
2011/0168064 A1 * 7/2011 Jahnsen ..... A47B 13/021 108/147
2013/0255544 A1 * 10/2013 Scharing ..... A47B 21/00 108/50.01
2014/0026788 A1 * 1/2014 Kallio, III ..... A47B 21/007 108/6
2016/0037907 A1 * 2/2016 Ergun ..... A47B 9/02 108/147
2016/0088930 A1 * 3/2016 Hansen ..... F16F 9/0245 108/147
2017/0071332 A1 * 3/2017 Herring ..... A47B 21/0314
2017/0238696 A1 * 8/2017 Ehrreich ..... A47B 3/0912
2017/0251802 A1 * 9/2017 Lu ..... A47B 3/06
2017/0354246 A1 12/2017 Wayner et al.
2018/0064241 A1 * 3/2018 Tseng ..... F15B 15/1409
2019/0082823 A1 * 3/2019 Applegate ..... A47B 9/00
2020/0154876 A1 * 5/2020 Liu ..... A47B 1/08
2020/0170407 A1 * 6/2020 Knapp ..... A47B 9/20
2020/0214439 A1 * 7/2020 Bennett ..... A47B 9/04

FOREIGN PATENT DOCUMENTS

CN 204427248 U 7/2015
DE 102011011738 B4 5/2016
DE 102015105827 A1 * 10/2016 ..... A47B 1/08
DE 102019131012 A1 5/2020
EP 0145410 A2 6/1985
EP 2223630 B1 2/2013
EP 3257401 A1 * 12/2017 ..... A47B 13/081
EP 3461369 A1 * 4/2019 ..... A47B 21/02
GB 2467954 A 8/2010
JP 2008191437 A 8/2008
JP 2016137166 A * 8/2016 ..... A47B 9/00
JP 3222124 U * 7/2019 ..... A47B 9/20
WO WO-2018072187 A1 * 4/2018 ..... A47B 9/10

* cited by examiner

VERTICALLY ADJUSTABLE DESK WITH UNDER-CARRIAGE MOUNTING SYSTEM

BACKGROUND

Vertically adjustable desks typically include a work surface which is supported by a first and a second leg, both the first and the second let of the desk are vertically adjustable to change the elevation of the work surface. Such adjustable desks are becoming more popular due to the flexible height of the work surface and the ability of the user to sit at the desk work surface or stand at the work surface of the desk. Further, the available space below the horizontal work surface may be utilized for other purposes whether the desk is raised or lowered.

SUMMARY

This specification is directed generally to systems and mechanisms which allow for affixing various accessories and attachments to the underside of the vertically adjustable desk through the use of an under-carriage mounting system so that attachment of accessories directly to the work surface is not required. The undercarriage mounting system affixes variously to the runner supports under the horizontal work surface and ensuring the longitudinal support of the desk while allowing use of the area under the desk by a number of attached accessories.

The vertically adjustable desk having the under-carriage mounting system may include the first and the second telescoping leg which each are attached to a respective first and second U-shaped support bracket. The respective U-shaped support brackets receive first and second runner supports which extend longitudinally along the underside of the horizontal work surface and between the first and second telescoping support legs. The U-shaped brackets may receive the first and second runner supports within tubular legs to secure the runner supports to the U-shaped brackets. The U-shaped brackets may also incorporate at least one thread plate or other attachment surface on one or both of the tubular legs to receive various accessories. In some implementations, the U-shaped brackets may receive eyelets to connect to hanging accessories below the work surface. In alternative embodiments, the brackets may receive a desk extension assembly which may also support a CPU. In still further implementations, an accessory may span between the U-shaped brackets and hence attached to both the first and the second bracket.

In some implementations, the vertically adjustable desk having an under carriage mounting system includes a work surface supported by a first and a second telescoping leg wherein each of the first and second telescoping legs have a foot, at least one electric motor operably connected to the first and the second telescoping leg, an electrical switch in electrical connection with the electric motor to activate the at least one electric motor to cause the first and second telescoping leg to raise or lower the work surface, the first telescoping leg having a first foot and the second telescoping leg having a second foot, a first leg support on the first leg supporting the work surface and a second leg support on the second leg supporting the work surface, a first and a second runner support extending between the first leg support and the second leg support, at least part of the work surface supported by the first and the second runner support; a first U-shaped support bracket affixed to a first end of the first and the second runner support and a second U-shaped support bracket affixed to a second end of the first and the second runner support; each of the first and the second U-shaped bracket having a plurality of apertures for receiving an attachment screw.

In variations, the vertically adjustable desk where the first and the second tubular leg may include a cross support connection, the first tubular leg receiving the first runner support and the second tubular leg receiving the second runner support. While shown in the various embodiments, the cross support connection may be positioned in different locations, combined with other hardware structure, or removed all together so that the U-shaped support brackets may instead be includes of only the first and second leg without the cross support connection.

In embodiments, the first and the second U-shaped support bracket may each include a thread plate having the plurality of apertures for receiving an attachment screw. Further, in some implementations, the apertures in the U-Shaped support bracket could be threaded apertures. In even further embodiments, the plurality of apertures include at least one aperture of a first diameter and at least one aperture of a second diameter different than the first diameter.

To ensure stability, in some embodiments, the first and the second U-shaped support bracket is affixed to the work surface. In even further implementations, the first U-shaped support bracket may be affixed to the first leg support on the first leg and the second U-shaped support bracket may be affixed to the second leg support on the second leg.

In aspects, the runners which are provided and which extend between the support legs may be in substantially parallel relationship. In addition or in place thereof, the first and the second leg supports may be integrated with the respective first and second legs. As well in addition or in place thereof, the first U-shaped support bracket may have an open end, the open end affixed to the first leg support, and the second U-shaped support bracket may have an open end, the open end of the second U-shaped support bracket affixed to the second leg support. As well and in some implementations of the desk described herein, the first and the second U-shaped support bracket may have an eyelet bracket removably affixed respectively thereto.

In other implementations, the vertically adjustable desk having an under carriage mounting system may include a work surface supported by a first and a second telescoping leg, each of said first and said second telescoping leg having a foot, at least one electric motor operably connected to the first and the second telescoping leg, an electrical switch in electrical connection with the electric motor to activate the at least one electric motor to cause the first and second telescoping leg to raise or lower the work surface, the first telescoping leg having a first foot and the second telescoping leg having a second foot, a first leg support on the first leg supporting the work surface and a second leg support on the second leg supporting the work surface, a first and a second runner support extending between the first leg support and the second leg support, at least part of the work surface supported by the first and the second runner support; a first U-shaped support bracket affixed to a first end of the first and the second runner support and a second U-shaped support bracket affixed to a second end of the first and the second runner support; wherein the first and the second U-shaped support bracket each include a first tubular leg and a second tubular leg, the first tubular leg receiving the first runner support and the second tubular leg receiving the second runner support; the first and the second U-shaped support supporting the work surface and respectively secured to the first and the second telescoping leg.

In some implementations, the overall structure of the vertically adjustable desk may be modified from those set out above. For example, the vertically adjustable desk may include a work surface supported by a first and a second vertically adjustable leg, each of said first and said second vertically adjustable leg having a foot. The vertically adjustable desk may include at least one electric motor operably to vertically adjust the first and the second leg and also have an electrical switch in electrical connection with the at least one electric motor to activate the at least one electric motor causing the first and second leg to raise or lower the work surface. In embodiments, the first leg may have a first foot and the second leg may have a second foot, the first and second foot working to stabilize the vertically adjustable desk, particularly when accessories are attached. The desk may include at least one runner support extending between the first leg and the second leg and also incorporate a first U-shaped support bracket affixed to a first end of the at least one runner support and a second U-shaped support bracket affixed to a second end of the at least one runner support. The first and the second U-shaped support bracket may each include a first leg and a second leg, the first and second U-shaped support attached to the at least one at least one runner support in order to securely affix the runner, legs and work surface all together. The first and the second U-shaped support work to support the work surface and respectively are secured to the first and the second telescoping leg.

Multiple variations and combinations of the features set forth herein may be understood and achieved to provide a vertically adjustable desk having support for the accessories noted.

It should be appreciated that all combinations of the foregoing concepts and additional concepts described in greater detail herein are contemplated as being part of the subject matter disclosed in this specification. For example, all combinations of claimed subject matter appearing at the end of this disclosure are contemplated as being part of the content and subject matter disclosed herein.

DETAILED DESCRIPTION

Various implementations of vertically adjustable desks may utilize an under-carriage mounting system that incorporates the various support brackets and attachable accessories as disclosed herein. Beneficially, the system described herein allows the support structure of a vertically adjustable desk to support various accessories underneath the work surface of the desk. Particularly, due to the nature of the vertically adjustable desk, significant space may be created by raising the desk as well as moving items outside of the desk frame. Incorporating the under-carriage mounting system as disclosed herein, the support structure for the vertically adjustable desk may be utilized to affix multiple accessories to the desk in a stable manner while not interfering with the operability and usability of the vertically adjustable desk itself. Particularly, the under-carriage mounting system variously described herein allows the desks to be utilized for supporting a number of accessories directly to the support structure of the desk, such CPU holders, desk extenders and eyelets for supporting other structures such as a hammock, foot rest and the like.

A number of implementations disclosed herein allow the vertically adjustable desk to integrate accessories to the under-carriage support structure of the desk thereby allowing the space under the work surface to be more efficiently utilized. As well, the under-carriage mounting system integrates directly with the support structure of the vertically adjustable desk without requiring restructuring or redesign of the adjustable portion of the desk.

Figure 2:
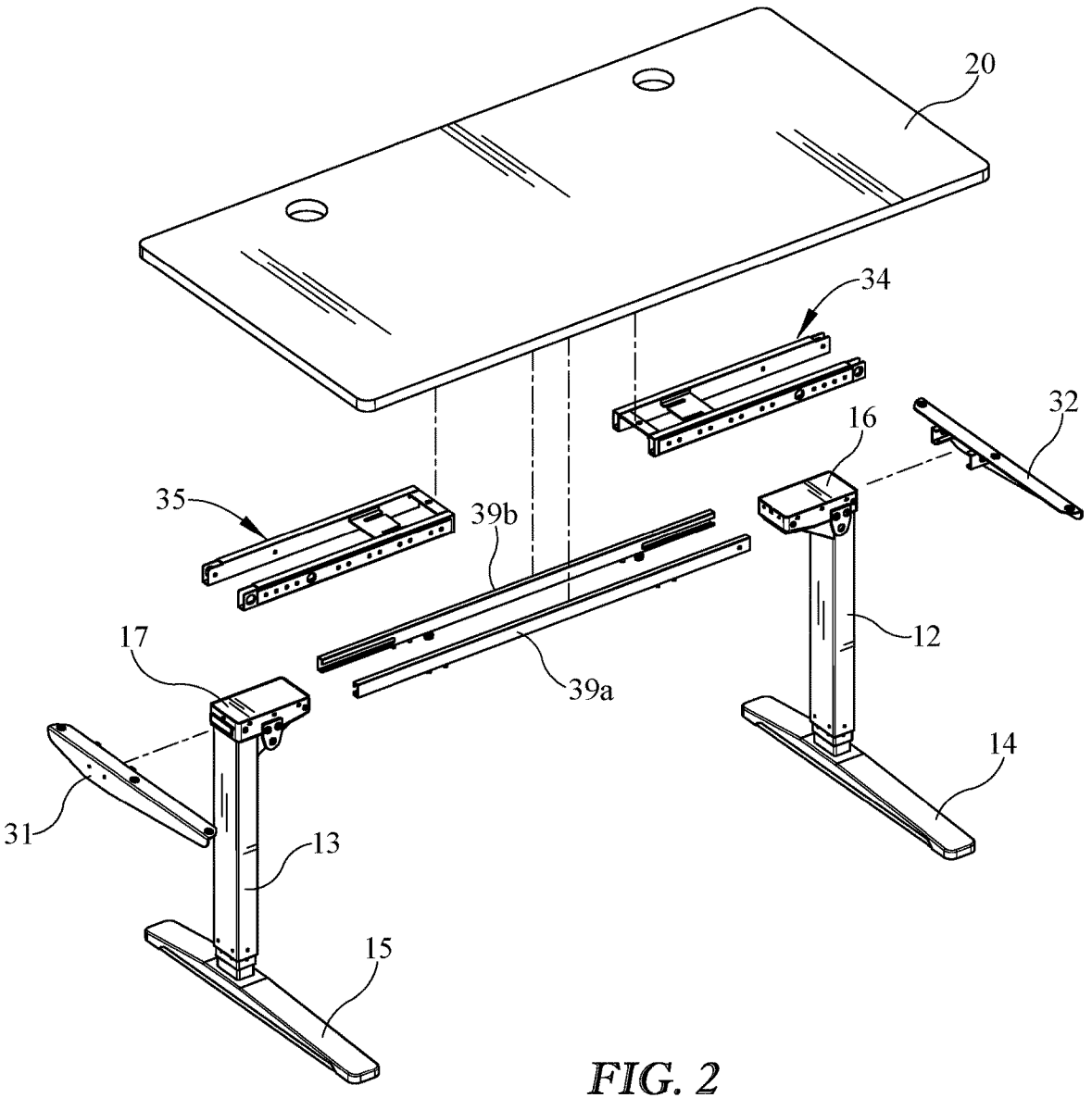
FIG. 2 depicts an exemplary exploded view of one of the under-carriage mounting brackets as shown of FIG. 1.
Figure 3:
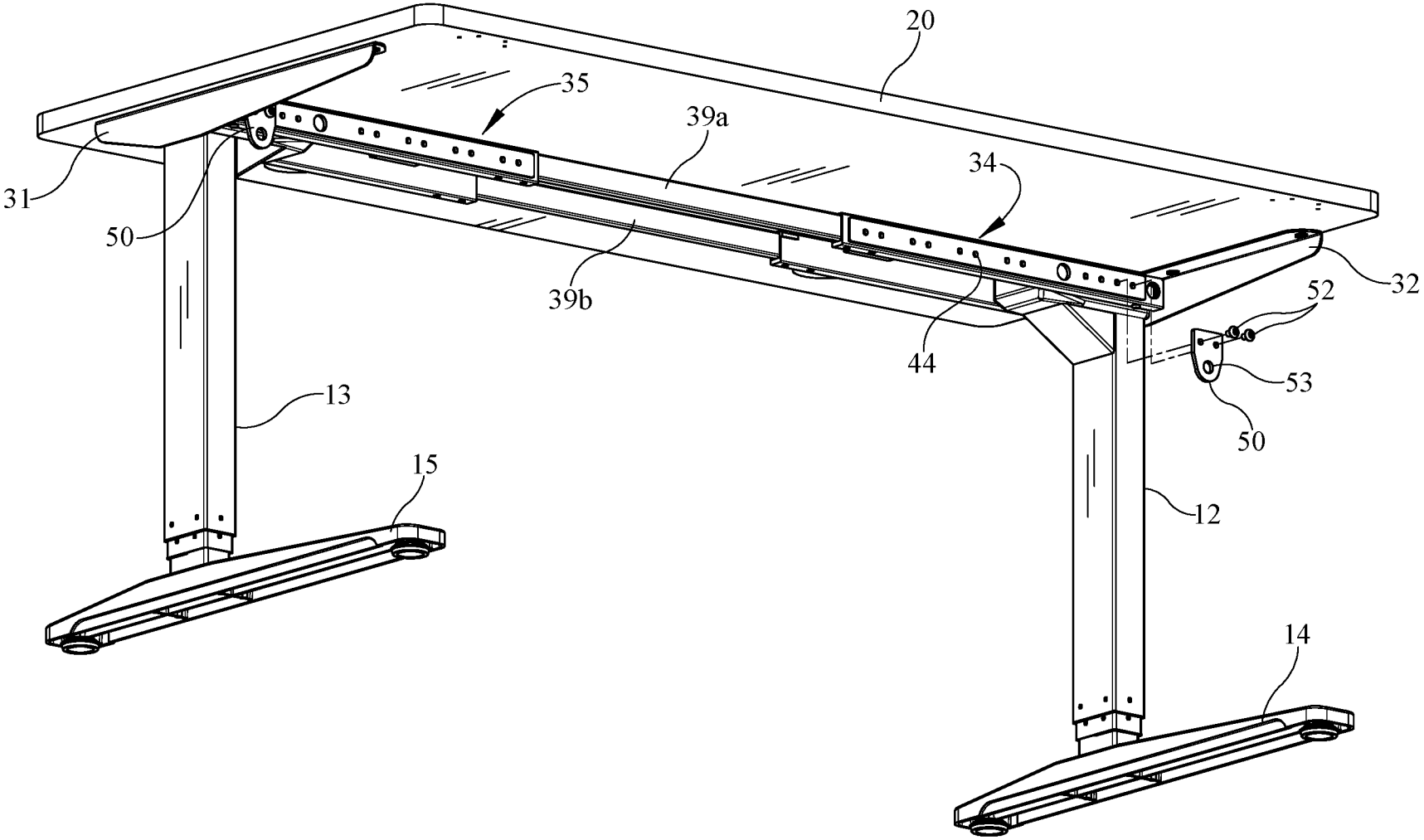
FIG. 3 depicts an underside view of one of the under-carriage mounting brackets as shown of FIG. 2.
Figure 4:
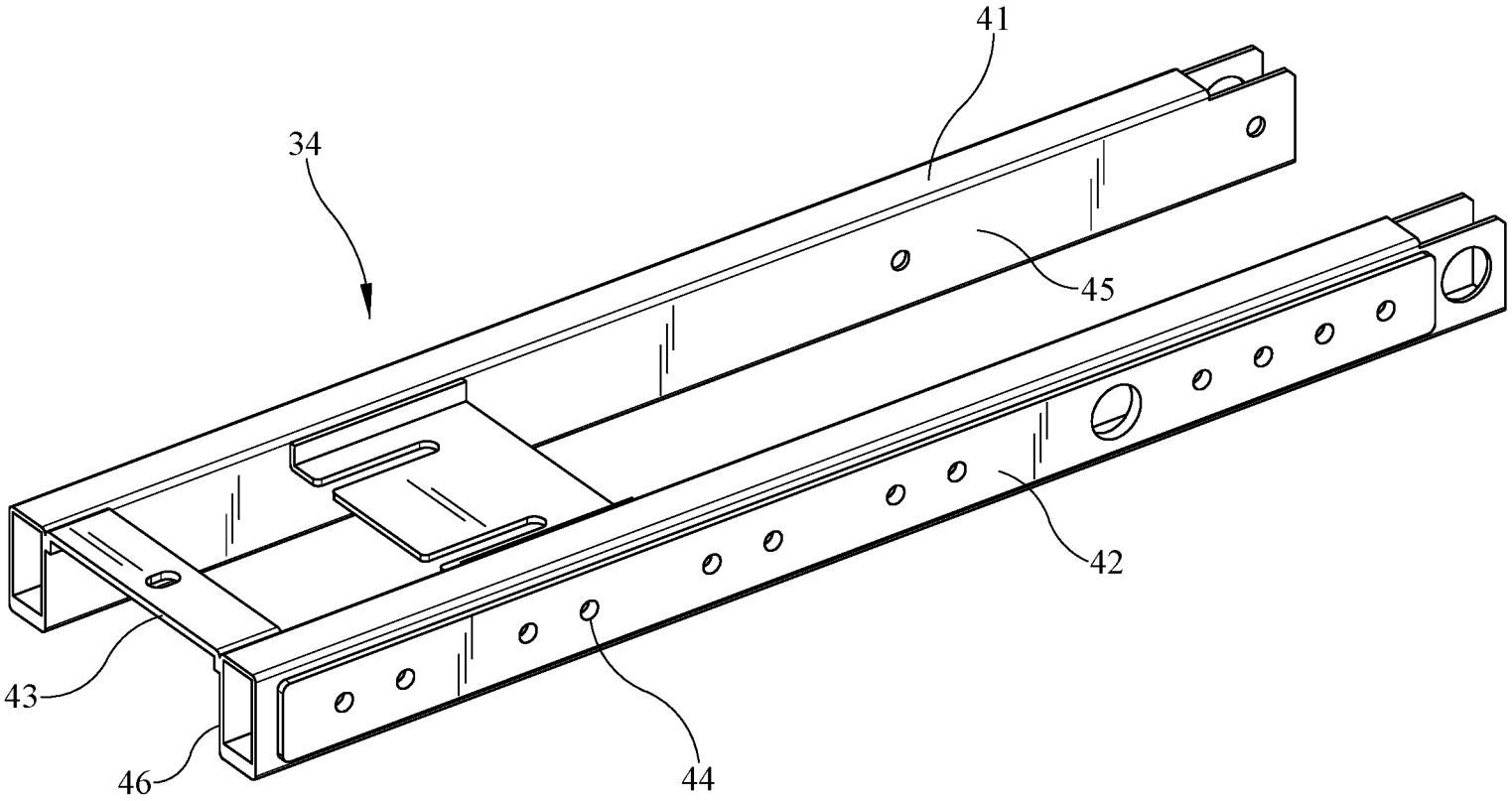
FIG. 4 depicts one implementation of a U-shaped support bracket disclosed herein.

As shown in FIGS. 2, 3 and 4, the multiple structural elements of the under-carriage mounting system are depicted. The vertically adjustable desk typically includes a horizontal work surface supported by first and second support legs 12 and 13 which have respective first and second support foot 14, 15, both of which act to stabilize the vertically adjustable desk. The first and the second support legs may be, in various embodiments, telescoping support legs which have at least one electric motor 69 allowing the work surface 20 to be raised and lowered by extending and/or retracting the telescoping portions of the first and second adjustable legs 12, 13. In implementations, one or two electric motors are positioned adjacent the respective vertically adjustable leg, for example at the top of the individual leg, and are controllably attached to a control panel 20*a* which allows the user to modify the vertical position of the work surface 20. In many implementations, the control panel 20*a* includes an up and down button to raise and lower the horizontal work surface by activating respective motors adjacent to or in each first and second leg 12, 13. Thus the user control interface 20*a* may include a button for up, down as well as preset buttons which store various positions of the horizontal work surface 20. The vertical motion of the first and second legs may be implemented through linear actuators or lifting columns which may be positioned internally to the telescoping legs 12, 13 or which may be integral therewith. Various embodiments may include a single motor to actuate vertical adjustment of the legs or dual motors, each placed at or near the adjustable leg.

As depicted in the example of FIG. 2, the under-carriage mounting system may include a first and a second runner support 39*a*, 39*b* which are positioned between the first and the second support legs 12, 13. The first and the second runner supports 39*a*, 39*b* may be on a lower side of the horizontal work surface 20 and may be held in position by first and second U-Shaped support brackets 34, 35. In some implementations, the U-shaped support brackets may be affixed to respective first and second support legs 12, 13. The first and the second runner supports 39*a*, 39*b* may provide support and stability for the work surface 20 by extending along all or at least a portion of the underside of the work surface 20. In some implementations, the runner supports may span the entire distance between the first and the second support leg and be affixed directly to the vertically adjustable support legs. In other implementations, the first and second runner supports may extend below the horizontal work surface and may be braced to the respective support legs with interposing hardware. For example, in implementations, the interposing hardware may include the first and the second U-shaped support brackets 34, 35 which may directly attach to the runner supports.

In variations, the vertically adjustable desk may include at least one runner support when extends from a first to a second vertically adjustable leg. The at least one runner support may be affixed to the first and second U-Shaped support brackets which are connected to the first and second vertically adjustable legs 12, 13. Hence, the work surface 20, supported by a combination of the at least one runner support, first and second U-shaped brackets and the vertically adjustable legs work on combination to fully support the work surface and allow the work surface to be positionally modified. Also, as outlined herein, the U-shaped supports can be used to support other accessories as noted herein while allowing legs to fully stabilize the desk and carry the weight of the vertically adjustable desk and accessory.

In some implementations, the first and the second U-shaped support brackets may be integral with the first and the second runner supports. In other implementations, the first and the second U-shaped brackets may variously attached to the runner supports. For example, in some implementations, the runner supports may be affixed to structural support member of the U-shaped support bracket. In other implementations, the U-shaped support brackets may receive each of the first and the second runner supports. For example, the first and the second U-shaped support brackets 34, 35 may include a first leg and a second leg which are tubular or which have tubular receiving channels 46, each of the first and second tubular leg portions 45, 46 receiving the respective runner support 39*a*, 39*b* and be retained thereto by affixation mechanism such as a screw, bolt or other device. In examples, the tubular leg portions 45, 46 for both the first and the second U-shaped bracket 34, 35 should be of adequate length to provide adequate support for the runner supports 39*a*, 39*b* as well as the horizontal work surface 20. AS depicted in FIG. 4, the longitudinally extending tube 41 for the bracket may be of sufficient length to stabilize and adequately support the runners.

In implementations, the U-shaped support brackets may each include a cross member support 43 which connects the two legs 45, 46. The cross member support 43 may also attach to the underside of the horizontal work surface 20 to stabilize the work surface and connection between it and the support legs. As well, the first and the second U-shaped support brackets may have an open end opposite the cross support 43, the open end allowing the U-shaped support bracket to receive at least a portion of the respective first or second vertically adjustable support leg 12, 13 or side brackets 31, 32. In some implementations, the U-shaped support brackets may be affixed directly to the support leg. For example, the U-shaped brackets may be attached directly to the vertically adjustable leg itself. In other implementations the U-shaped bracket open end may receive a corresponding leg support or other structure. For example, the first and the second vertically adjustable leg 12, 13 may have a leg support structure 16, 17 at a top end thereof which may be received within the open end of the respective U-shaped bracket. In such implementation, the respective leg 45, 46 may be then affixed through screw, bolt or permanent affixation methods to the leg support or to the top end of the vertically adjustable leg. Electric motors or other actuation devices for raising and lowering the legs 12, 13 may be placed in the interior of the leg support structures 16, 17 and be operably connected to the switch 20*a*.

In implementations, the each of the legs of the U-shaped support bracket may extend around the first and the second leg support 16, 17 and affix directly to the respective first or second vertically adjustable leg 12, 13. By extending around the leg supports, the respective leg supports 16, 17 at the top of the support legs 12, 13 may be utilized to contain the motors or other actuators for vertical adjustment of the respective legs.

In embodiments, the U-shaped support brackets may be affixed to the top end of the vertically adjustable legs by cross bolts. Additionally or in place thereof, each of the U-shaped brackets may be affixed to the support leg by more permanent affixation such as solder. As shown in FIG. 4, the U-shaped bracket 34 includes apertures in the respective legs at the open end to receive a bolt which may extend also through the vertically adjustable support leg or adjacent structure of adjustable leg 12.

In implementations, the U-shaped bracket as depicted in FIG. 4 may also have corresponding attachment surfaces for affixation of accessories and the like. For example, the U-shaped bracket 34 of FIG. 4 may include a thread plate 42 having a plurality of apertures 44 formed along one surface. The thread plate 42 may allow various accessories to be affixed directly to the support bracket below the horizontal work surface 20. The attachment surface in examples may be the thread plate 42 or may simply include an integrated surface of the first leg 46.

U-shaped bracket 34 depicted in the figures may also include a plurality of apertures 44 to receive screws or other attachment devices for accessories. In some implementations, the apertures may be threaded apertures to receive threaded screws. In addition or on place thereof the plurality of apertures may also be of varying sizes/diameters. For example, some accessories may need to be attached to the U-shaped support bracket through larger apertures due to the necessity of heavier support. The plurality of apertures may extend through the thread plate 42 and, in some implementations, through the wall of the first leg 46. In such implementations, the attachment device or screw would impact directly against the runner support 39*a*. Alternatively, the thread plate 42 may simply allow the attachment device, such as a screw, to merely tap into the threads of the attachment plate and not impinge into the interior or the first tubular leg 46.

In some embodiments, the thread plate or other attachment structure of the first and second U-shaped support bracket may allow attachment of accessories to either the first or second leg 45, 46. As shown in the figures, the first leg 46 is utilized for affixing the accessories to the underside of the desk. However, where needed, both the first and the second legs may be utilized to support and affix to accessories where needed.

As shown in FIG. 2, both the first and the second leg 12, 13 have a respective side bracket 32, 31 in order to cover the associated structure of the leg supports 16, 17, support brackets 34, 35, runner supports 39*a*, 39*b* and other related hardware.

Figure 1:
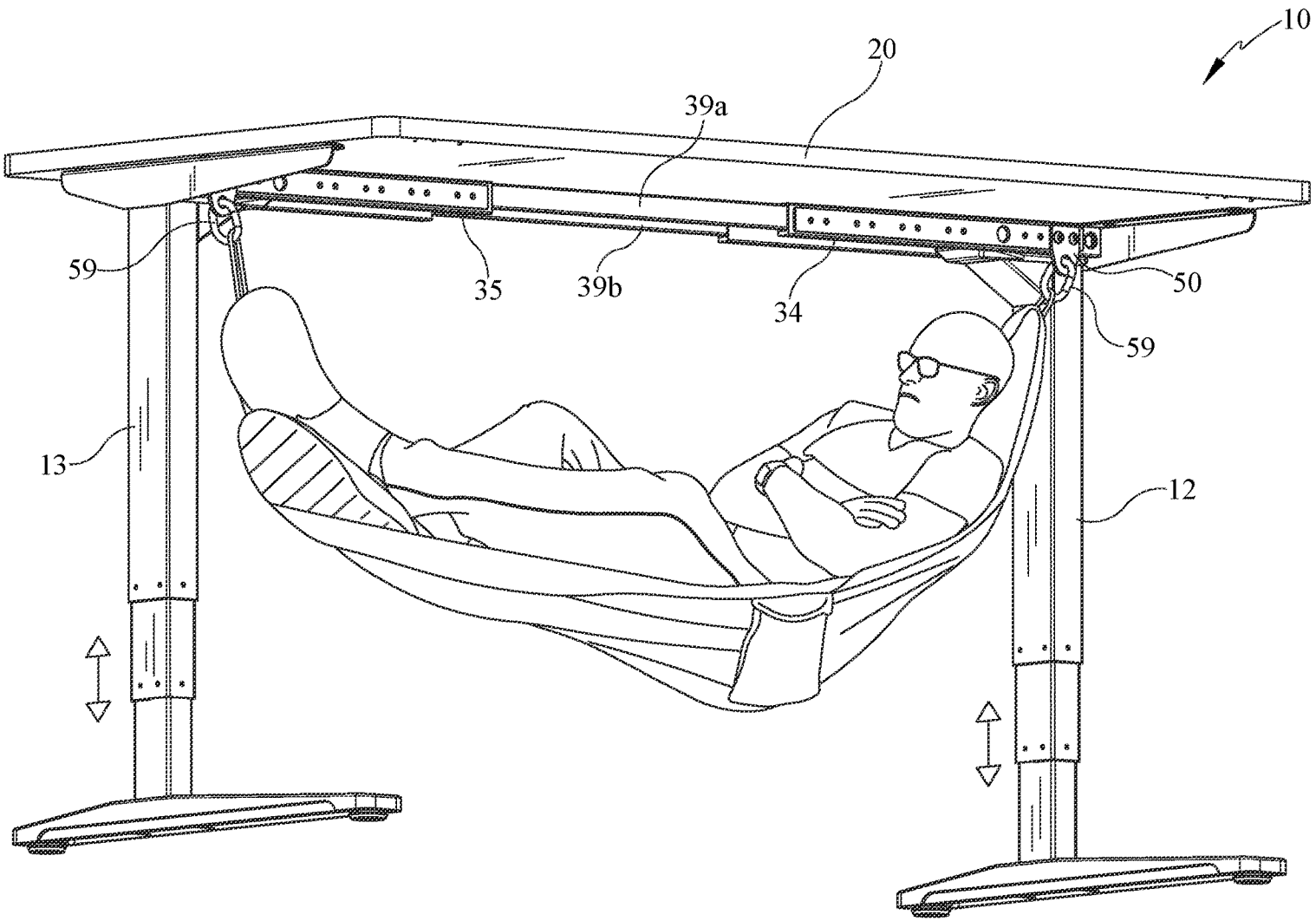
FIG. 1 depicts an undercarriage mounting system for a vertically adjustable desk in which implementations as disclosed and described herein may be implemented.

Turning to FIG. 1, the vertically adjustable desk with under-carriage mounting system 10 described herein. In the embodiment of FIG. 1, 3, the vertically adjustable support legs 12, 13 support the horizontal work surface 20. Each of the support legs are affixed to the first and the second U-shaped support bracket 34, 35. Affixed by attachment screws 52 to each of the U-shaped brackets are an eyelet accessory 50. The eyelet accessory 50 includes an open aperture which, in the depicted implementation, allows a carabiner 59 to be attached. In the depicted example, the carabiners are utilized to support a hammock below the work surface wherein the support position of the eyelet accessory 50 is centrally located such that appropriate weight can be evenly supported by the first and second support legs 12, 13. Of course, with the position of the eyelet accessory 50, any number of additional attachment accessories may be utilized.

Depicted in the example accessory implementation of FIG. 3, the eyelet accessory 50 with the eyelet aperture 53 is shown in one of many possible attachment locations along the plurality of apertures 44 of the U-shaped support bracket 34. In the example of FIG. 3, the plurality of apertures 44 are positioned in pairs along the side surface of the first leg 46. Hence, depending on what is attached to the eyelet accessory 50, it may be positioned anywhere along the lateral position of the thread plate 42.

Figure 5:
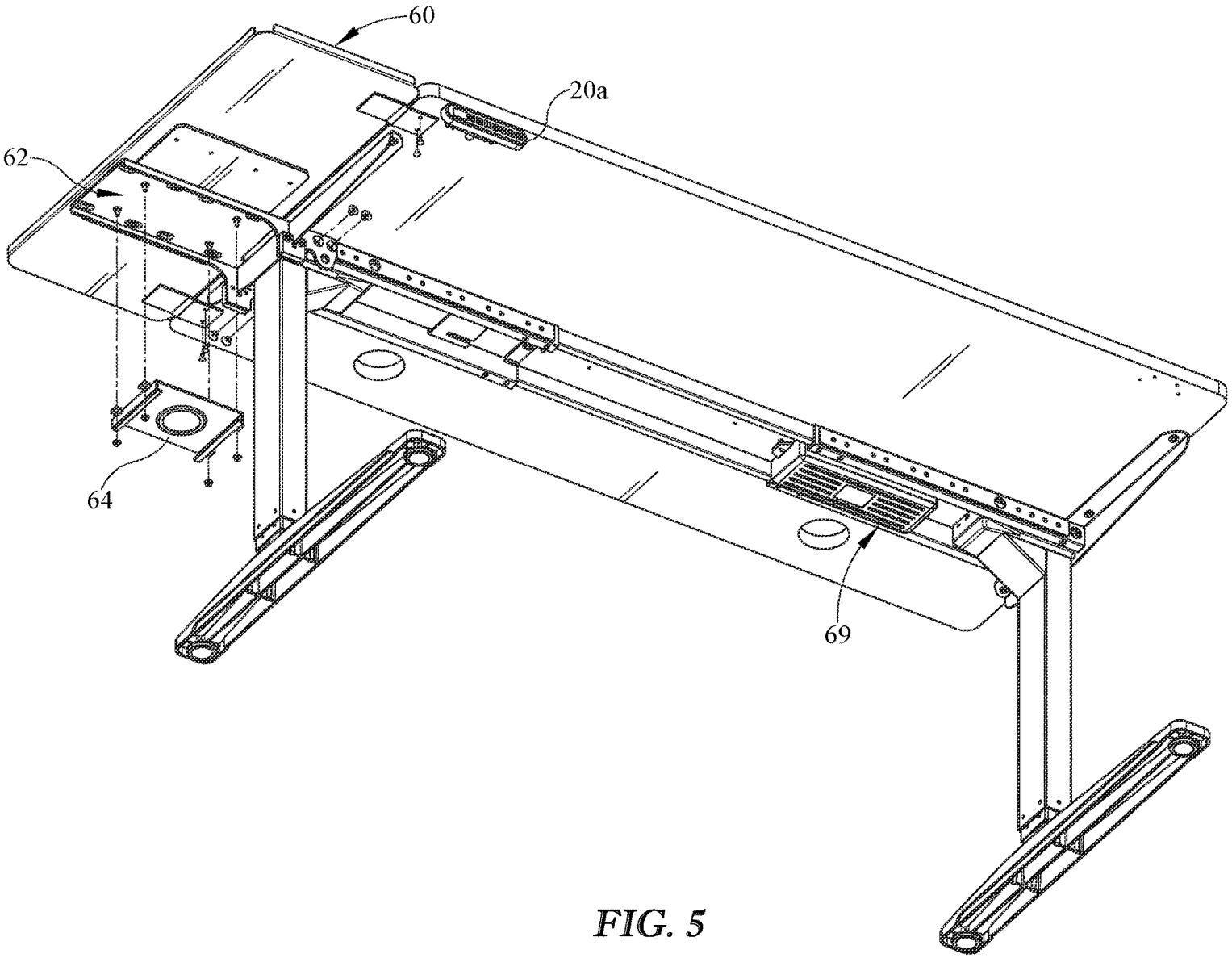
FIG. 5 depicts another implementation of a lower view for an under-carriage mounting bracket described herein.
Figure 6:
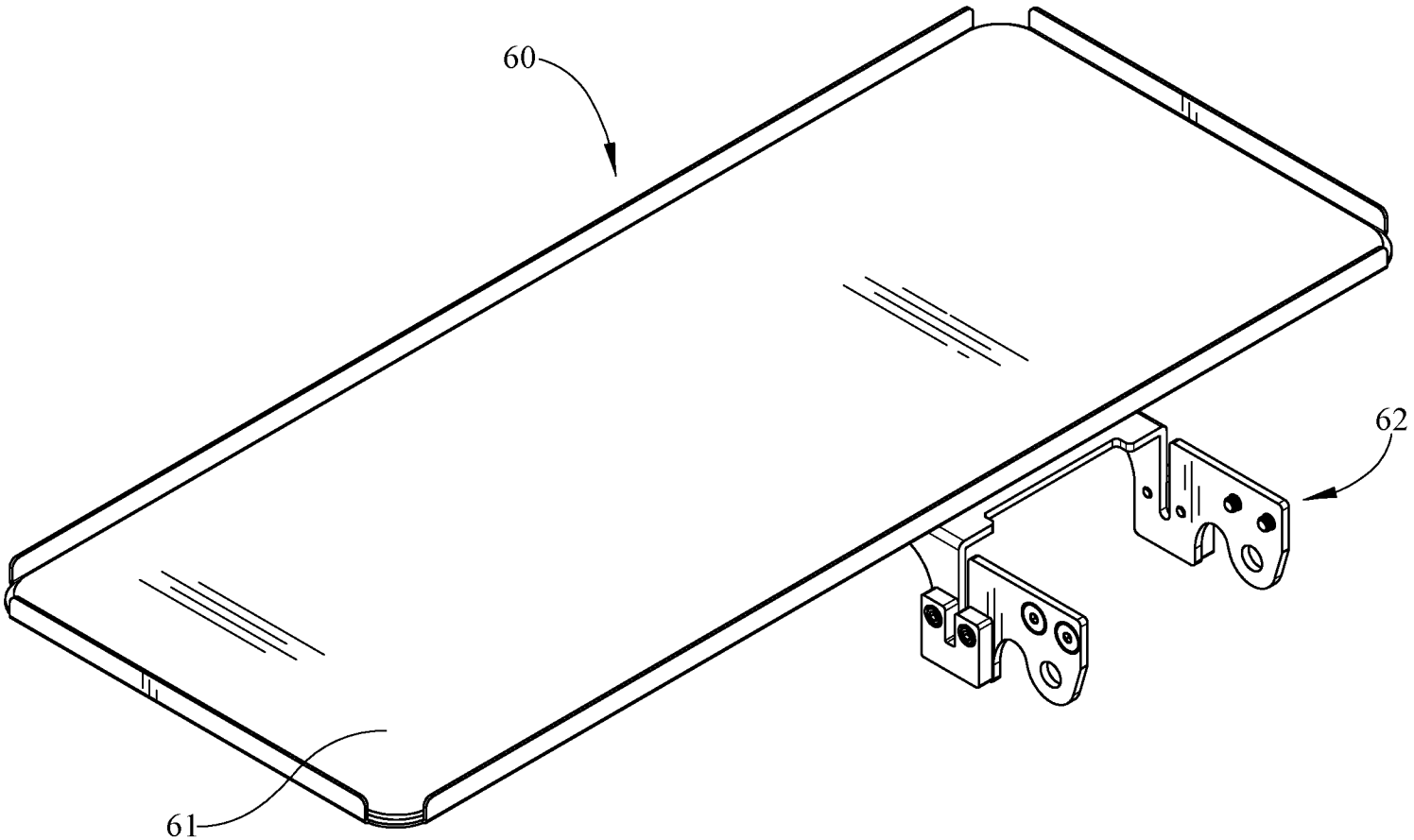
FIG. 6 discloses an upper perspective view of the desk extension assembly of FIG. 5.
Figure 7:
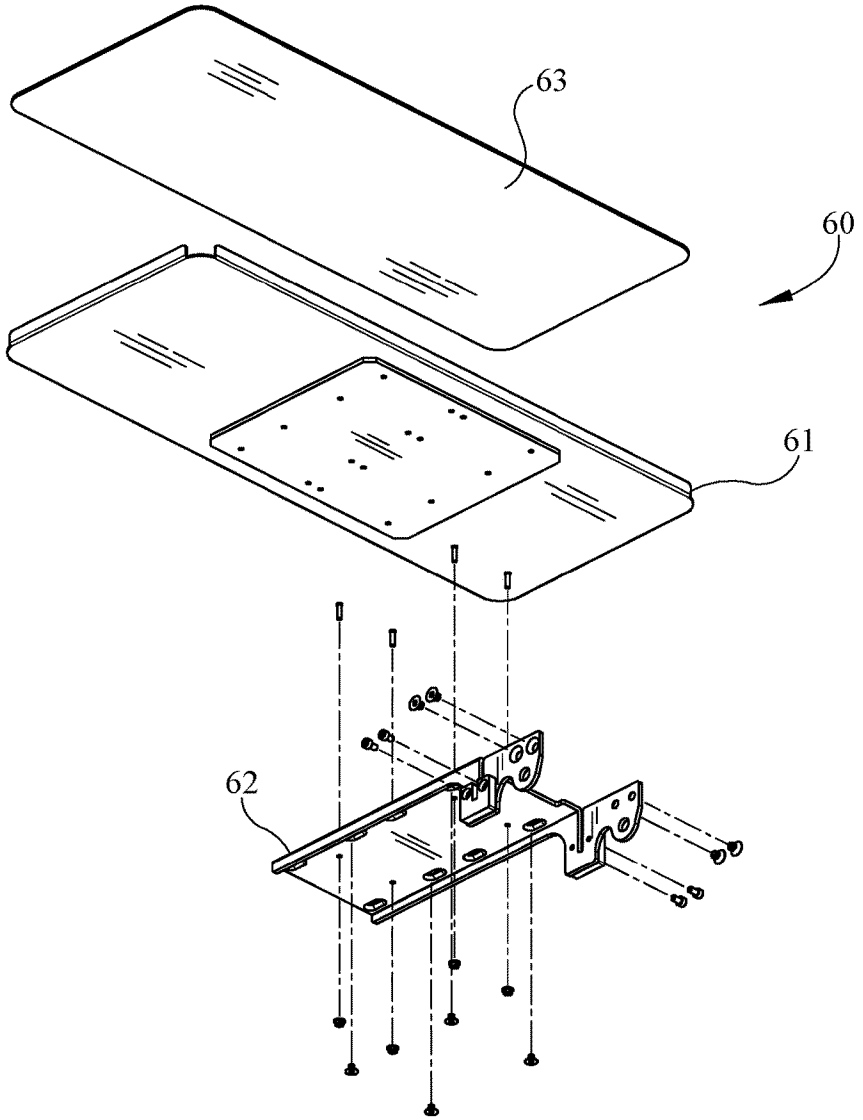
FIG. 7 discloses an exploded view of the desk extension assembly of FIG. 6.

Turning to the exemplary implementation of FIGS. 5, 6 and 7, a desk extender assembly 60 is affixed to the end of the U-shaped support brackets 34, 35. The desk extender assembly 60 includes an attachment bracket 62 which extends, in this example, below the extension tray 61 and around the second side bracket 31 to be affixed to the first and the second leg of the U-shaped support bracket 35. In such implementations, both the first and the second leg of the U-shaped support bracket have apertures or other structure for receiving or attachment to the attachment bracket 62. For example, in some implementations, each of the legs of the U-shaped support bracket 34, 35 may have slots which receive associated insertion hardware, such as hooks, in order to attach the various accessories. In the depicted example, the desk extension assembly 60 is attached to the under-carriage mounting system utilizing a plurality of threaded screws. However, as noted, the attachment bracket 62 could also include hooks or other means to hang, affix or insert the bracket 62 onto the respective U-shaped support bracket 34, 35.

Also depicted in FIGS. 5, 6 and 7 are the CPU holder or CPU holder mounting plate 64 which may attach to the underside of the attachment bracket 62 or extension tray 61. The extension tray 61, shown in FIG. 7 receives a desk extension or protective pad 63 which can be inserted into the tray 61 so that the desk finish of the work surface 20 matches the extension 63, while maintaining the same bracketing and support hardware there below. CPU holder or CPU holder mounting plate 64 may be utilized to attach a desktop or other computer to the undersurface of the desktop extension so that the computer can hang therefrom and be supported and suspended directly by the attachment bracket. Hence, the U-shaped support bracket of the vertically adjustable desk raises and lowers with the computer and the corresponding cords and can keep the computer off the ground and directly adjacent to the underside of the horizontal work surface 20.

Figure 8:
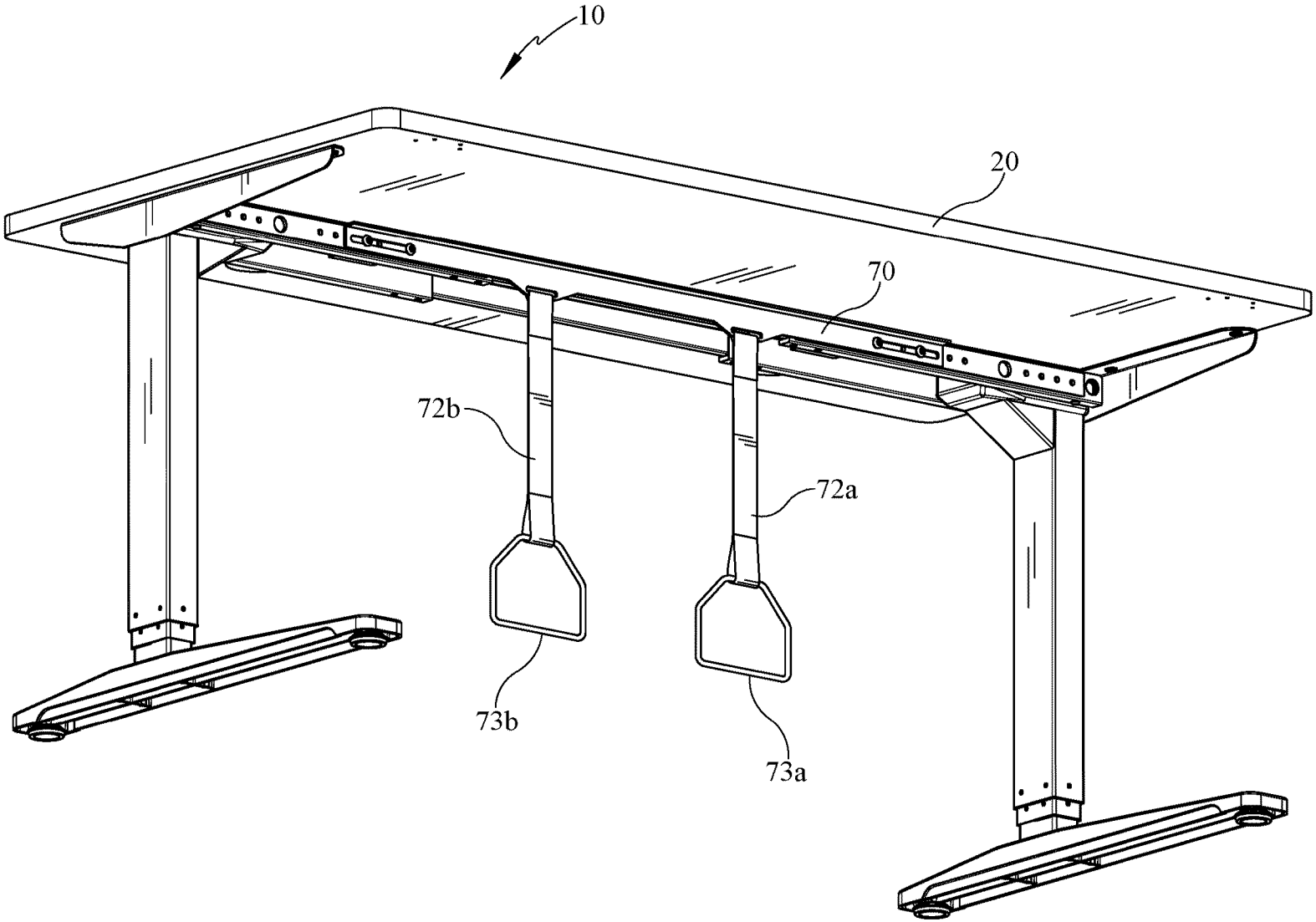
FIG. 8 depicts another implementation of a lower view for an under-carriage mounting bracket described herein.

The embodiment of FIG. 8 includes a support bar 70 affixed at a first end to the first U-shaped support bracket 34 and at a second end to the second U-shaped support bracket 35. The support 70 may be designed so as to support stirrup foot rests 73*a*, 73*b* or other accessories such as foot rests which are suspended from the support bar 70 by straps 72*a*, 72*b*. The accessory embodiment depicted in FIG. 8 utilizes a longer support bar 70 which spans the underside of the desk and the first and the second U-shaped support bracket 34, 35 in order to centrally support and suspend the accessory mostly near a center-line of the work surface 20. Of course, alternative structures and attachment points between the accessory and the support brackets may be implemented for positioning of the accessory in differing locations under the work surface.

While several inventive embodiments have been described and illustrated herein, those of ordinary skill in the art will readily envision a variety of other means and/or structures for performing the function and/or obtaining the results and/or one or more of the advantages described herein, and each of such variations and/or modifications is deemed to be within the scope of the inventive embodiments described herein. More generally, those skilled in the art will readily appreciate that all parameters, dimensions, materials, and configurations described herein are meant to be exemplary and that the actual parameters, dimensions, materials, and/or configurations will depend upon the specific application or applications for which the inventive teachings is/are used. Those skilled in the art will recognize, or be able to ascertain using no more than routine experimentation, many equivalents to the specific inventive embodiments described herein. It is, therefore, to be understood that the foregoing embodiments are presented by way of example only and that, within the scope of the appended claims and equivalents thereto, inventive embodiments may be practiced otherwise than as specifically described and claimed. Inventive embodiments of the present disclosure are directed to each individual feature, system, article, material, kit, and/or method described herein. In addition, any combination of two or more such features, systems, articles, materials, kits, and/or methods, if such features, systems, articles, materials, kits, and/or methods are not mutually inconsistent, is included within the inventive scope of the present disclosure.

All definitions, as defined and used herein, should be understood to control over dictionary definitions, definitions in documents incorporated by reference, and/or ordinary meanings of the defined terms.

The indefinite articles "a" and "an," as used herein in the specification and in the claims, unless clearly indicated to the contrary, should be understood to mean "at least one."

The phrase "and/or," as used herein in the specification and in the claims, should be understood to mean "either or both" of the elements so conjoined, i.e., elements that are conjunctively present in some cases and disjunctively present in other cases. Multiple elements listed with "and/or" should be construed in the same fashion, i.e., "one or more" of the elements so conjoined. Other elements may optionally be present other than the elements specifically identified by the "and/or" clause, whether related or unrelated to those elements specifically identified. Thus, as a non-limiting example, a reference to "A and/or B", when used in conjunction with open-ended language such as "comprising" can refer, in one embodiment, to A only (optionally including elements other than B); in another embodiment, to B only (optionally including elements other than A); in yet another embodiment, to both A and B (optionally including other elements); etc.

As used herein in the specification and in the claims, "or" should be understood to have the same meaning as "and/or" as defined above. For example, when separating items in a list, "or" or "and/or" shall be interpreted as being inclusive, i.e., the inclusion of at least one, but also including more than one, of a number or list of elements, and, optionally, additional unlisted items. Only terms clearly indicated to the contrary, such as "only one of" or "exactly one of," or, when used in the claims, "consisting of," will refer to the inclusion of exactly one element of a number or list of elements. In general, the term "or" as used herein shall only be interpreted as indicating exclusive alternatives (i.e. "one or the other but not both") when preceded by terms of exclusivity, such as "either," "one of," "only one of," or "exactly one of." "Consisting essentially of," when used in the claims, shall have its ordinary meaning as used in the field of patent law.

As used herein in the specification and in the claims, the phrase "at least one," in reference to a list of one or more elements, should be understood to mean at least one element selected from any one or more of the elements in the list of elements, but not necessarily including at least one of each and every element specifically listed within the list of elements and not excluding any combinations of elements in the list of elements. This definition also allows that elements may optionally be present other than the elements specifically identified within the list of elements to which the phrase "at least one" refers, whether related or unrelated to those elements specifically identified. Thus, as a non-limiting example, "at least one of A and B" (or, equivalently, "at least one of A or B," or, equivalently "at least one of A and/or B") can refer, in one embodiment, to at least one, optionally including more than one, A, with no B present (and optionally including elements other than B); in another embodiment, to at least one, optionally including more than one, B, with no A present (and optionally including elements other than A); in yet another embodiment, to at least one, optionally including more than one, A, and at least one, optionally including more than one, B (and optionally including other elements); etc.

It should also be understood that, unless clearly indicated to the contrary, in any methods claimed herein that include more than one step or act, the order of the steps or acts of the method is not necessarily limited to the order in which the steps or acts of the method are recited.

In the claims, as well as in the specification above, all transitional phrases such as "comprising," "including," "carrying," "having," "containing," "involving," "holding," "composed of," and the like are to be understood to be open-ended, i.e., to mean including but not limited to. Only the transitional phrases "consisting of" and "consisting essentially of" shall be closed or semi-closed transitional phrases, respectively, as set forth in the United States Patent Office Manual of Patent Examining Procedures, Section 2111.03.

The invention claimed is:

1. A vertically adjustable desk with under carriage mounting system, comprising:

a work surface supported by a first and a second telescoping leg, each of said first and said second telescoping leg having a foot;

at least one electric motor operably connected to the first and the second telescoping leg;

an electrical switch in electrical connection with the at least one electric motor to activate the at least one electric motor to cause the first and second telescoping leg to raise or lower the work surface;

the first telescoping leg having a first foot and the second telescoping leg having a second foot;

a first leg support on the first telescoping leg supporting the work surface and a second leg support on the second telescoping leg supporting the work surface;

a first and a second runner support extending between the first leg support and the second leg support, at least part of the work surface supported by the first and the second runner support;

a first U-shaped support bracket affixed to a first end of the first and the second runner support and a second U-shaped support bracket affixed to a second end of the first and the second runner support;

the first U-shaped support bracket affixed to the first leg support on the first telescoping leg and the second U-shaped support bracket affixed to the second leg support on the second telescoping leg;

the first U-shaped support bracket having an open end, the open end affixed to the first leg support;

the second U-shaped support bracket having an open end, the open end of the second U-shaped support bracket affixed to the second leg support;

each of the first and the second U-shaped support bracket having a first tubular leg and a second tubular leg connected by a cross support, the first tubular leg receiving the first runner support and the second tubular leg receiving the second runner support, and a plurality of apertures for receiving an attachment screw.

2. The vertically adjustable desk with under carriage mounting system of claim 1 wherein the first and the second U-shaped support bracket each include a thread plate having the plurality of apertures for receiving the attachment screw.

3. The vertically adjustable desk with under carriage mounting system of claim 2 wherein the first and the second U-shaped support bracket plurality of apertures are threaded apertures.

4. The vertically adjustable desk with under carriage mounting system of claim 2 wherein the first and the second U-shaped support bracket plurality of apertures include at least one aperture of a first diameter and at least one aperture of a second diameter different than the first diameter.

5. The vertically adjustable desk with under carriage mounting system of claim 1 wherein the first and the second U-shaped support bracket is affixed to the work surface.

6. The vertically adjustable desk with under carriage mounting system of claim 1 wherein the first and the second runner support are in substantially parallel relationship.

7. The vertically adjustable desk with under carriage mounting system of claim 1 wherein the first and the second leg support are integrated with the respective first and second leg.

8. The vertically adjustable desk with under carriage mounting system of claim 1 wherein the first and the second U-shaped support bracket has an eyelet bracket removably affixed respectively thereto.

9. A vertically adjustable desk with under carriage mounting system, comprising:

a work surface supported by a first and a second telescoping leg, each of said first and said second telescoping leg having a foot;

at least one electric motor operably connected to the first and the second telescoping leg;

an electrical switch in electrical connection with the at least one electric motor to activate the at least one electric motor to cause the first and second telescoping leg to raise or lower the work surface;

the first telescoping leg having a first foot and the second telescoping leg having a second foot;

a first leg support on the first telescoping leg supporting the work surface and a second leg support on the second telescoping leg supporting the work surface;

a first and a second runner support extending between the first leg support and the second leg support, at least part of the work surface supported by the first and the second runner support;

a first U-shaped support bracket affixed to a first end of the first and the second runner support and a second U-shaped support bracket affixed to a second end of the first and the second runner support;

wherein the first U-shaped support bracket includes a first tubular leg and a second tubular leg, the first tubular leg receiving the first runner support at a closed end of the first U-shaped support bracket and the second tubular leg receiving the second runner support at the closed end of the first U-shaped support bracket;

wherein the second U-shaped support bracket each includes a first tubular leg and a second tubular leg, the first tubular leg receiving the first runner support at a closed end of the second U-shaped support bracket and the second tubular leg receiving the second runner support at the closed end of the second U-shaped support bracket;

the first and the second U-shaped support bracket supporting the work surface and respectively secured to the first and the second telescoping leg wherein each of the first and the second U-shaped support bracket having a plurality of apertures for receiving an attachment screw to support at least one accessory from at least one of the first and the second U-shaped support bracket.

10. A vertically adjustable desk with under carriage mounting system, comprising:

a work surface supported by a first and a second vertically adjustable leg, each of the first and the second vertically adjustable leg having a stabilizing foot;

at least one electric motor operable to vertically adjust the first and the second adjustable leg;

an electrical switch in electrical connection with the at least one electric motor to activate the at least one electric motor causing the first and second vertically adjustable leg to raise or lower the work surface;

the first vertically adjustable leg having a first foot and the second vertically adjustable leg having a second foot, the first and second foot working to stabilize the vertically adjustable desk;

at least one runner support extending between the first vertically adjustable leg and the second vertically adjustable leg under the work surface;

a first U-shaped support bracket affixed to a first end of the at least one runner support and a second U-shaped support bracket affixed to a second end of the at least one runner support;

wherein the first and the second U-shaped support bracket each include a first leg and a second leg, the first and second U-shaped support bracket attached to the at least one runner support;

the first U-shaped support bracket having an open end receiving at least a portion of the first leg within the first U-shaped support bracket open end;

the second U-shaped support bracket having an open end receiving at least a portion of the second leg within the second U-shaped support bracket open end;

the first and the second U-shaped support bracket supporting the work surface and respectively secured to the first and the second vertically adjustable leg;

wherein each of the first and the second U-shaped support bracket having a first tubular leg and a second tubular leg connected by a cross support, the first tubular leg receiving the at least one runner support and the second tubular leg receiving the at least one runner support, and a plurality of apertures operable for supporting at least one accessory from at least one of the first and the second U-shaped support bracket.

* * * * *